US006811062B2

(12) United States Patent
Tani

(10) Patent No.: US 6,811,062 B2
(45) Date of Patent: Nov. 2, 2004

(54) MOVABLE BODY DISPENSING DEVICE

(75) Inventor: Yoshikazu Tani, Tokyo (JP)

(73) Assignee: Tokiwa Corporation (JP)

( * ) Notice: Subject to any disclaimer, the term of this patent is extended or adjusted under 35 U.S.C. 154(b) by 8 days.

(21) Appl. No.: 10/614,452

(22) Filed: Jul. 7, 2003

(65) Prior Publication Data

US 2004/0007599 A1 Jan. 15, 2004

(30) Foreign Application Priority Data

Jul. 9, 2002 (JP) ..... P2002-200309
May 15, 2003 (JP) ..... P2003-137803

(51) Int. Cl.[7] ..... B67D 5/42
(52) U.S. Cl. ..... 222/390; 222/391; 401/172
(58) Field of Search ..... 222/390, 391; 401/172, 176

(56) References Cited

U.S. PATENT DOCUMENTS 5,323,934 A * 6/1994 Isert ..... 222/390
5,725,133 A * 3/1998 Iaia ..... 222/390
6,155,735 A * 12/2000 Nakajima ..... 401/172
6,227,739 B1 * 5/2001 Kageyama ..... 401/172

FOREIGN PATENT DOCUMENTS

JP 2000-262324 9/2000 ..... A45D/34/04

OTHER PUBLICATIONS

Patent Abstract of Japan Publication No. 2000–262324, dated Sep. 26, 2000, 1 page.

* cited by examiner

*Primary Examiner*—Philippe Derakshani
(74) *Attorney, Agent, or Firm*—Osha & May L.L.P.

(57) ABSTRACT

It becomes possible for the rotational force generated by an operating member (12, ) to be transmitted to a cylindrical movable body (13) by means of a shaft member (62) inserted slidably in the longitudinal direction in a non-rotatable fashion, inside the movable body (13), and moreover, the shaft member (62) becomes able to pass inside the movable body (13) by penetrating through the inner side of the ratchet spring section (81), a composition being adopted wherein the shaft member (62) passes through the female screw thread (11*a*) of the main body (11) which screws together with the male screw thread (13*a*) of the movable body (13). Thereby, the shaft member (62) forming a tube side rotation preventing section and the female screw thread (11*a*) of the main body (11) forming a tube side screw thread section overlap mutually in the same plane orthogonal to the axial direction, and furthermore, the shaft member (62) forming the tube side rotating preventing section and the ratchet teeth (14*a*, 14*b*) overlap mutually in the same plane in orthogonal to the axial direction. Consequently, the overall length can be shortened in comparison to a prior art movable body dispensing device, whilst maintaining the same dispensing amount, and hence satisfactory downsizing can be achieved.

6 Claims, 6 Drawing Sheets

MOVABLE BODY DISPENSING DEVICE

BACKGROUND OF THE INVENTION

1. Field of the Invention

The present invention relates to a movable body dispensing device used, for example, for a liquid cosmetic material extruding vessel, or the like, by which the user can extrude and use liquid cosmetic material contained therein, as appropriate.

2. Related Background Art

Prior Art

A conventional movable body dispensing device is disclosed, for example, in Japanese Patent Application Laid-Open No. 2000-262324, which comprises: a columnar movable body formed with a male screw thread on the outer circumference thereof, and being formed with a plurality of longitudinally extending grooves that are open to the outer side and are aligned in the circumferential direction; a cylindrical main body, having a female screw thread, which screws together with the male thread of the movable body inserted from the rear side of the cylindrical main body, formed on the intermediate portion of the inner circumference of the cylindrical main body; and a cylindrical operating member coupled rotatably to the rear end section of the main body, having projecting ribs which interlock with the grooves of the movable body and are provided on the inner circumference of the cylindrical operating member; the movable body being inserted slidably in a non-rotatable fashion in the longitudinal direction and the movable body being progressively dispensed by relative rotation of the main body and the operating member.

SUMMARY OF THE INVENTION

Problems to be Solved by the Invention

However, in recent years, with consumer needs which emphasize the portability and ease of use of products, there have been demands to compactify products by shortening the overall length of conventional movable body dispensing devices, without changing the length of the movable body dispensed by same.

Therefore, it is an object of the present invention to provide a movable body dispensing device which is capable of shortening the overall length of the device in comparison with the prior art, whilst maintaining the same dispensing amount, in such a manner that product downsizing can be achieved satisfactorily.

Means for Solving the Problems

In order to resolve the aforementioned problem, the movable body dispensing device relating to a first aspect of the invention is a movable body dispensing device comprising: a cylindrical movable body having a male screw thread formed on the external circumference thereof; a cylindrical main body having a female screw thread which screws together with the male screw thread of the movable body, formed on the intermediate portion of the internal circumference thereof; a cylindrical operating member coupled rotatably to the rear end section of the main body, comprising a shaft member provided so as to project towards the front side from a base provided at the rear end thereof, the shaft member being fittable slidably in the longitudinal direction, in a non-rotatable fashion, into the movable body engaged with the female screw thread; and a ratchet comprising a set of ratchet teeth and a ratchet spring, for restricting the movement of the movable body in the forward direction or rearward direction; the movable body being progressively dispensed by causing relative rotation of the main body and the operating member; wherein a step section between the internal circumference of the intermediate portion and the internal circumference of the region apart from the intermediate portion is formed on the inner part of the cylindrical main body; the ratchet comprises a cylindrical ratchet spring section whereon at least one of the set of ratchet teeth and the ratchet spring are formed integrally; and the ratchet spring section is sandwiched between the step section of the main body and the inner side of the operating member, in such a manner that the shaft member penetrates through the inner side thereof and thereby enables the movable body to pass through the same.

Moreover, the movable body dispensing device relating to a second aspect of the invention is a movable body dispensing device comprising: a cylindrical movable body having a male screw thread formed on the external circumference thereof; a cylindrical main body having a female screw thread which screws together with the male screw thread of the movable body, formed on the intermediate portion of the internal circumference thereof; and a cylindrical operating member coupled rotatably to the rear end section of the main body, comprising a shaft member provided so as to project towards the front side from a base provided at the rear end thereof, the shaft member being fittable slidably in the longitudinal direction, in a non-rotatable fashion, into the movable body engaged with the female screw thread; the movable body being progressively dispensed by causing relative rotation of the main body and the operating member; wherein a plurality of projecting ribs respectively projecting to the outer side and extending in the longitudinal direction are formed in the circumferential direction on the external circumference of the shaft member; a plurality of grooves with fit mutually with the projecting ribs of the shaft member are formed on the internal circumference of the movable body; and the projecting ribs of the shaft member are constituted by projecting ribs wherein the intermediate portion thereof is larger than the size of the grooves, in such a manner that the region thereof from the front end side to the intermediate portion thereof can be inserted inside the grooves of the movable body, further insertion beyond this being prevented, and the movable body and the shaft member being maintained in prescribed relative positions in the radial direction.

In the technical means of this kind, desirably, the projecting ribs of the shaft member are formed on either side of depression sections having a recess shaped cross section, by excavating a plurality of locations so as to form a recess shaped cross section.

Moreover, the movable body dispensing device relating to a third aspect of the invention is a movable body dispensing device comprising: a main body tube; an operating tube provided on the rear end section of this main body tube and capable of relative rotation with respect to the main body tube; a movable body comprising a rotation preventing section and a screw thread section, inserted inside the main body tube and the operating tube; a tube side rotation preventing section for engaging in a non-rotatable fashion with the rotation preventing section of the movable body and guiding the movable body slidably in the axial direction; a tube side screw thread section for screwing together with the screw thread section of the movable body; and ratchets provided respectively on the main body tube and the operating tube, for mutually meshing and permitting rotation in one direction in synchronism with the relative rotation; the movable body being dispensed progressively towards the front end of the main body tube by means of the screwing together of the screw thread sections, the engagement of the rotation preventing sections, and the meshing of the ratchets; wherein the movable body is formed in a cylindrical shape, the screw thread section of the movable body being provided on either one of the inner circumference or external circumference thereof, and the rotation preventing section of the movable body being provided on the other of the inner circumference or external circumference; and the tube side rotation preventing section, the tube side screw thread section and the ratchets being arranged in an overlapping fashion in the same plane orthogonal to the axial direction.

In the technical means of this kind, desirably, there are also provided: a shaft member installed on the base section of the operating tube in a protruding manner in the axial direction; and a cylindrical member having a cylindrical shape and being installed consecutively so as to surround the front end side of the shaft member, whilst also being coupled in a non-rotatable fashion to the main body tube; the movable body being inserted in between the shaft member and the cylindrical member, the rotation preventing section of the movable body being provided on the internal circumference of the movable body, and the screw thread section of the movable body being provided on the external circumference of the movable body; the tube side rotation preventing section being provided on the external circumference of the shaft member and engages with the rotation preventing section of the movable body formed on the internal circumference of the movable body; the tube side screw thread section being provided on the internal circumference of the cylindrical member and screws together with the screw thread section of the movable body on the external circumference of the movable body; and the ratchets being arranged in such a manner that they surround the cylindrical member, or alternatively, there are also provided: a shaft member installed on the base section of the operating tube in a protruding manner in the axial direction; and a cylindrical member having a cylindrical shape and being installed consecutively so as to surround the front end side of the shaft member, whilst also being coupled in a non-rotatable fashion to the main body tube; the movable body being inserted in between the shaft member and the cylindrical member, the rotation preventing section of the movable body being provided on the external circumference of the movable body, and the screw thread section of the movable body being provided on the internal circumference of the movable body; the tube side rotation preventing section being provided on the internal circumference of the cylindrical member and engages with the rotation preventing section of the movable body formed on the external circumference of the movable body; the tube side screw thread section being provided on the external circumference of the shaft member and screws together with the screw thread section of the movable body on the internal circumference of the movable body; and the ratchets being arranged in such a manner that they surround the cylindrical member.

In the present invention, references to male screw thread and female screw thread include the concept of screw thread type projections and grooves which have a similar action to screw threads.

DESCRIPTION OF THE PREFERRED EMBODIMENTS

Embodiments

Below, an embodiment of the present invention is described in detail with reference to the accompanying drawings.

Here, the movable body dispensing device is described with respect to a case where it is applied to a liquid cosmetic material extruding vessel for extruding a liquid cosmetic material, such as foundation, blusher, or beauty lotion, but the invention is not limited to this and the following description would also be appropriate in the case of application to a liquid material, such as ink for a writing instrument, liquid pharmaceuticals, or the like, and also to a bar-shaped cosmetic material dispensing vessel for dispensing a bar-shaped cosmetic material which is a solid material, or the like.

Figure 1:
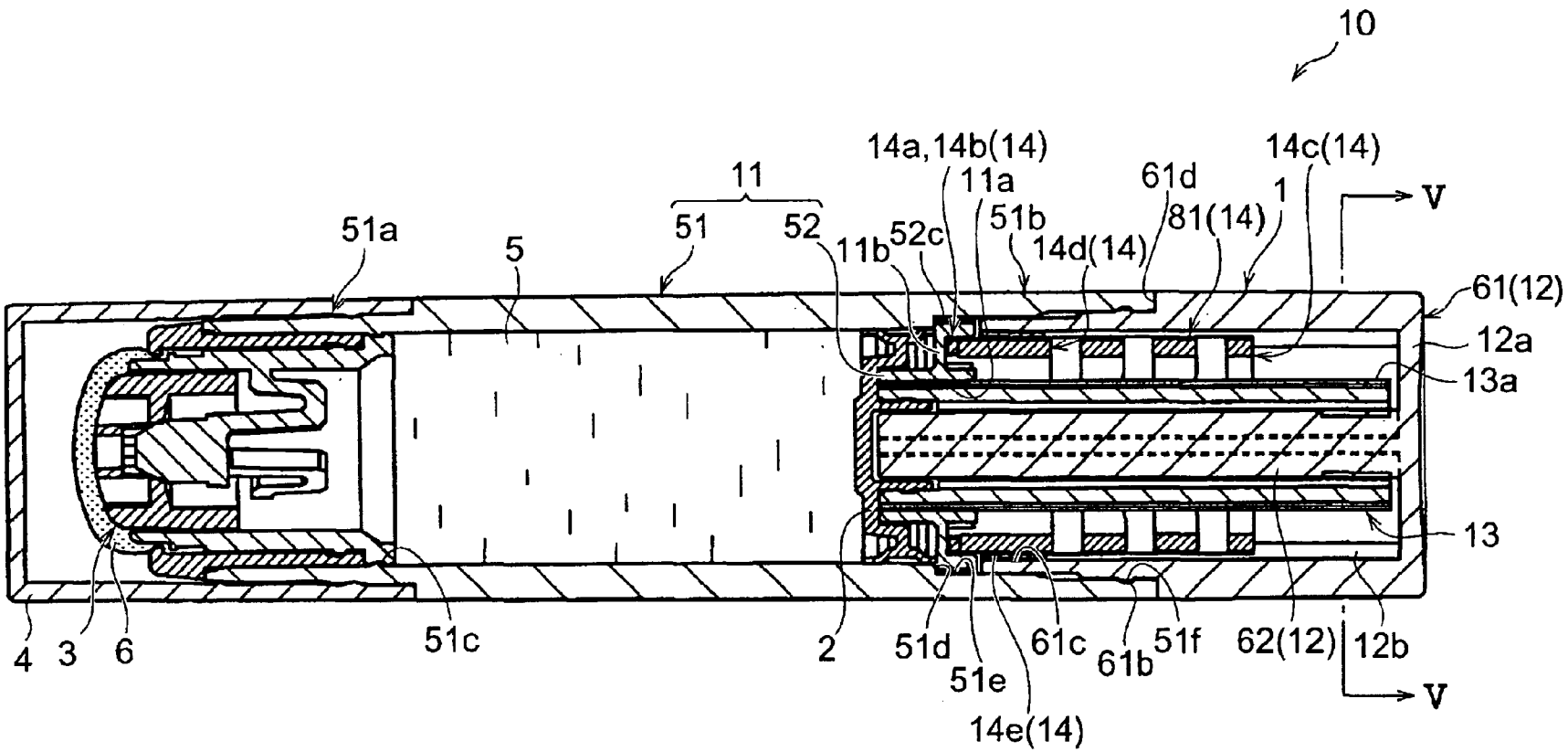
FIG. 1 is a vertical sectional view (before dispensing of the movable body) showing a liquid cosmetic extruding vessel to which the movable body dispensing device relating to one embodiment of the present invention is applied.
Figure 2:
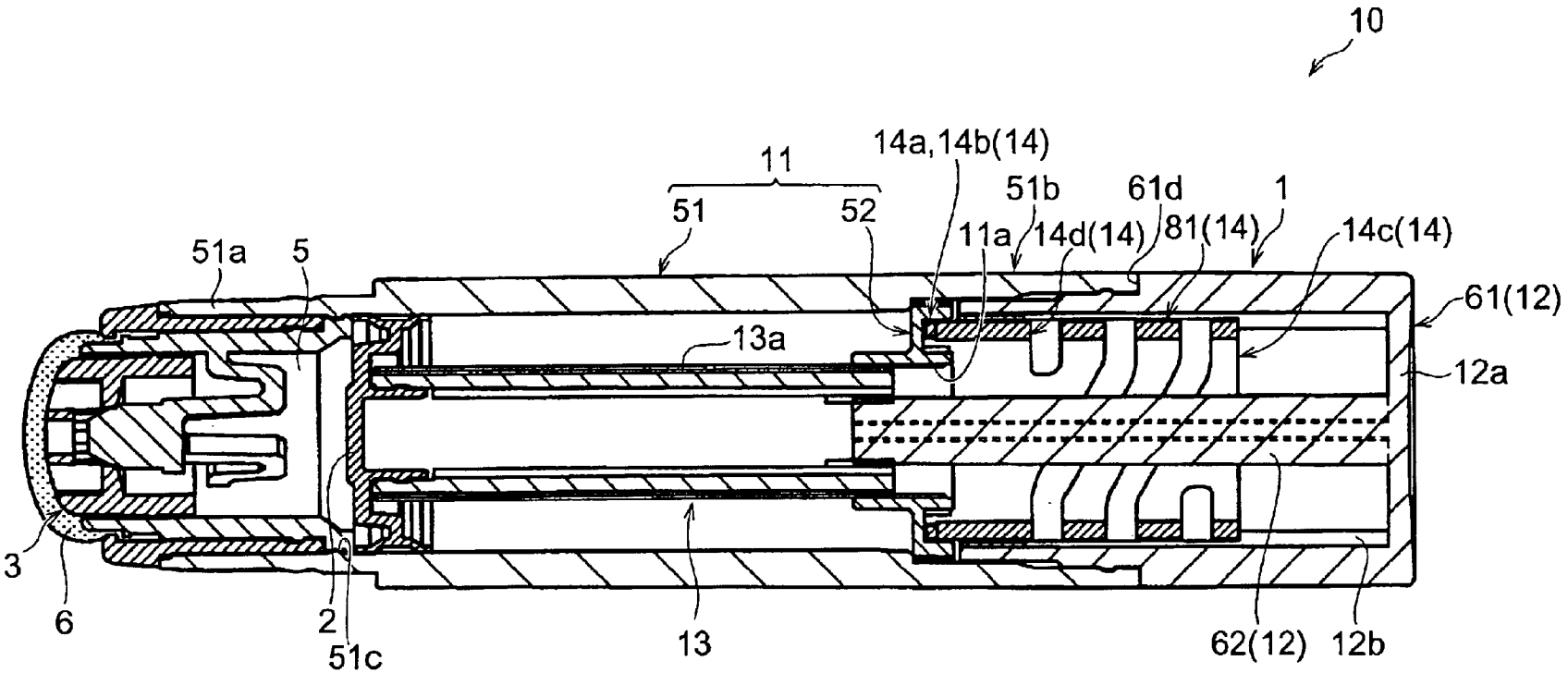
FIG. 2 is a vertical sectional view (after dispensing of the movable body) showing a liquid cosmetic extruding vessel to which the movable body dispensing device relating to one embodiment of the present invention is applied.

FIG. 1 is a vertical sectional view (before dispensing of the movable body) showing the overall composition of a liquid cosmetic material dispensing vessel to which a movable body dispensing device relating to a first embodiment of the present invention is applied; and FIG. 2 is a vertical sectional view (after dispensing of the movable body) showing the overall composition of a liquid cosmetic material dispensing vessel to which the same movable body dispensing device is applied.

In the present embodiment, as illustrated in FIG. 1, the liquid cosmetic dispensing vessel 10 comprises a movable body dispensing device 1, a piston 2, an discharge lid 3, and a cap 4. Moreover, as illustrated in FIG. 1 and FIG. 2, this liquid cosmetic material dispensing vessel 10 comprises a liquid cosmetic material accommodating region 5 formed inside the main body tube 51, for accommodating liquid cosmetic material.

Here, the piston 2 is formed in a circular disc shape, which contacts integrally with the front end section of a movable body 13, and is inserted slidably in the axial direction into the main body tube 51 whilst contacting with the inner circumference thereof (see FIG. 1 and FIG. 2).

Moreover, the discharge lid 3 is installed on the front end of the main body tube 51 and serves to expel liquid type cosmetic material pressed out by the piston 2 in accordance with the movement of the movable body 13, from the front end of the main body tube 51 (see FIG. 1 and FIG. 2). Of course, the invention is not limited to this, and provided that it can be installed on the front end of the main body tube 51, it is possible to use a brush, or the like, for example.

Moreover, the cap 4 is installed detachably on the front end tube section 51*a* of the main body tube 51, and serves to cover the coating member 6, or the like (see FIG. 1).

As illustrated in FIG. 1 and FIG. 2, the movable body dispensing device 1 comprises a cylindrical main body 11, a cylindrical operating member 12, a cylindrical movable body 13, and a ratchet 14.

In other words, the movable body dispensing device 1 is constituted as a device which serves progressively to dispense a movable body 13 by causing the main body 11 and the operating member 12 to perform relative rotation.

Below, more detailed descriptions of the respective constituent elements are given.

(1) Main Body 11

The main body 11 is formed with a female screw thread 11*a* in the intermediate portion of the inner circumference thereof, which screws together with a male screw thread 13*a* of a screw thread section of the movable body 13 inserted from the rear side of the main body 11, and a collar section

11*b* comprising a step section between the inner circumference of the intermediate portion and the inner circumference of the portions other than the intermediate portion is formed inside the main body 11 (see FIG. 1 and FIG. 2).

Specifically, the main body 11 comprises a main body tube 51 and a cylindrical member 52, as illustrated in FIG. 1 and FIG. 2.

The main body tube 51 is constituted by a circular cylindrical shaped member (see FIG. 1 and FIG. 2).

As described in FIG. 1, the main body tube 51 comprises a front end tube section 51*a* having a smaller external diameter on the front side thereof, and a rear end tube section 51*b* having a larger internal diameter on the rear end side thereof.

As this diagram shows, a ring-shaped projection 51*c* is formed on the inner circumference of the main body tube 51 at a position of a prescribed length from the front end thereof, and a plurality of projecting ribs 51*e* extending for a prescribed length in the axial direction are formed at equidistant intervals in the circumferential direction, at a position in the vicinity of a step section 51*d* of the rear end tube section 51*b*, and furthermore, a ring-shaped depression 51*f* is formed in a position towards the rear end of the main body tube 51.

On the other hand, as shown in FIG. 1, the cylindrical member 52 is inserted and disposed in a position towards is the step section 51*d* inside the rear end tube section 51*b* of the main body tube 51.

Figure 3:
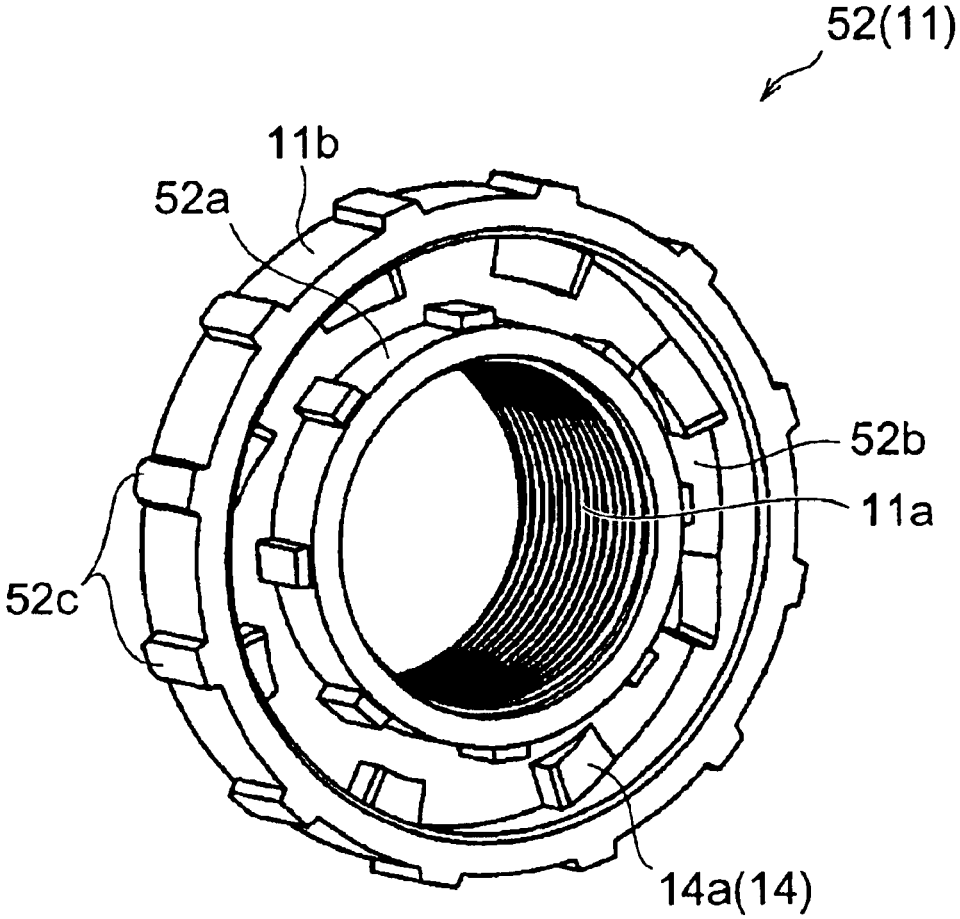
FIG. 3 is an oblique view showing a cylindrical member (main body) in FIG. 1 and FIG. 2.

As shown in FIG. 3, the cylindrical member 52 comprises a circular tube section 52*a* forming a circular tube shape, and a collar section 11*b* forming a step section formed integrally with the external circumference of the circular tube section 52*a*.

As FIG. 3 also shows, a female screw thread 11*a* forming a tube side screw thread section is provided on the inner circumference of the circular tube section 52*a*, centrally about the axis thereof. Moreover, as the diagram also shows, the rear end of the collar section 11*b* is formed with a depressed ring-shaped groove 52*b* formed in a ring shape, and a plurality of ratchet teeth 14*a* facing towards the rear end and projecting in an inclined manner in one of the circumferential directions are provided at equidistant intervals in the circumferential direction on the bottom face of this ring-shaped groove 52*b*.

Furthermore, as FIG. 3 also shows, a plurality of projecting ribs 52*c* extending in the axial direction are formed at equidistant intervals in the circumferential direction on the outer circumference of the collar section 11*b*.

As illustrated in FIG. 1 and FIG. 2, this cylindrical member 52 is urged by a ratchet spring section 81, described hereinafter, provided further to the rear end side thereof, and is coupled with the main body tube 51 in a non-rotatable fashion by means of the front end edge portion of the collar section 11*b* abutting against the step section 51*d* of the rear end tube section 51*b*, whilst the respective projecting ribs 52*c* of the collar section 11*b* are positioned in between the respective plurality of projecting ribs 51*e* formed in an longitudinal direction on the inner circumference of the main body tube 51.

(2). Operating Member 12

Figure 4:
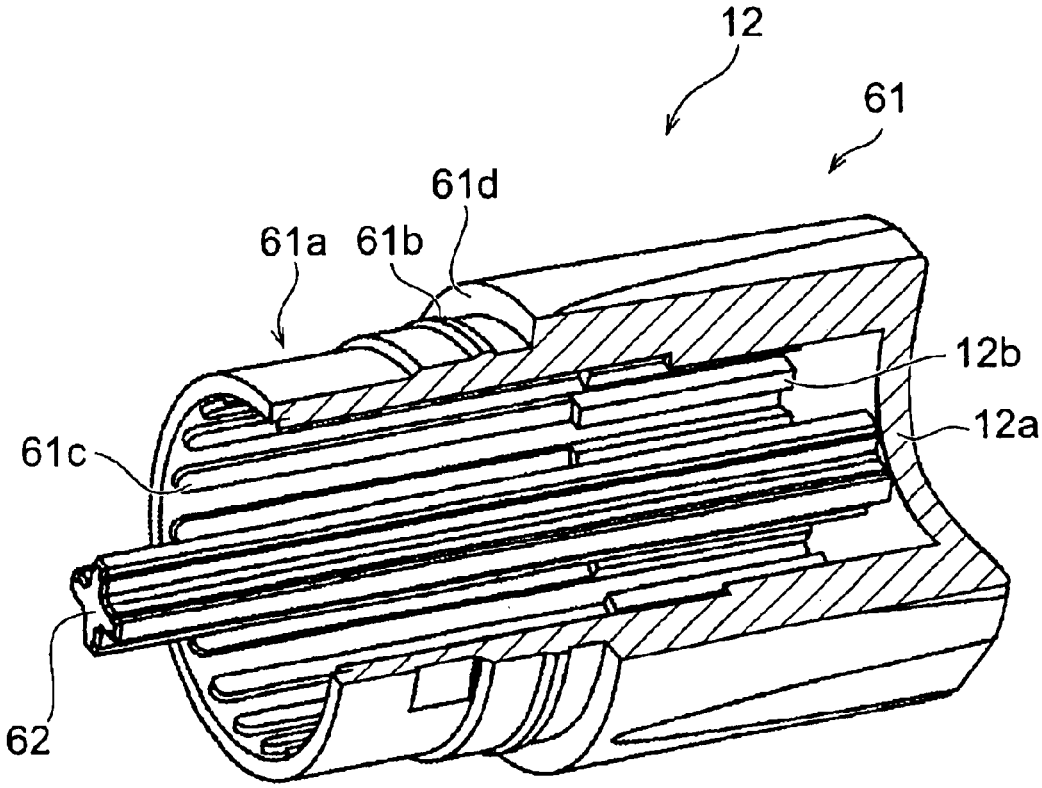
FIG. 4 is an oblique view showing an operating member in FIG. 1 and FIG. 2.

As shown in FIG. 1, FIG. 2 and FIG. 4, the operating member 12 has a base 12*a* on the rear end thereof, and is coupled to the rear end section of the main body 11 rotatably about the axis of the female screw thread 11*a*. A spring presser 12*b* forming a projecting section which projects further to the inner side than the front side of the inner circumference is provided intermittently in the circumferential direction on the rear side of the inner circumference of the operating member 12.

As illustrated by the diagrams, the operating member 12 is constituted by an operating tube 61 and a shaft member 62.

As shown in FIG. 4, the operating tube 61 is formed in a circular cylindrical shape. This operating tube 61 has a front end tube section 61*a* having a smaller external diameter on the front end thereof, and a ring-shaped projecting section 61*b* is provided on the outer circumference of this front end tube section 61*a*. Moreover, as illustrated by the diagram, a plurality of projecting ribs 61*c* extending for a prescribed length in the axial direction from the front end side are provided at equidistant intervals in the circumferential direction on the inner circumference of the operating tube 61, and spring pressers 12*b* are installed consecutively with the projecting ribs 61*c*, extending until the base 12*a* and projecting beyond the projecting ribs 61*c* towards the central axis.

As shown in FIG. 1, FIG. 2 and FIG. 4, the front end tube section 61*a* of the operating tube 61 is inserted inside the rear end tube section 51*b* of the main body tube 51, the step section 61*d* of the front end tube section 61*a* abuts with the rear end face of the main body tube 51, and the ring-shaped projecting section 61*b* fits into the ring-shaped depression 51*f* on the main body tube 51, thereby coupling the operating tube 61 to the main body tube 51 in a mutually rotatable fashion.

On the other hand, as shown in FIG. 1 and FIG. 2, the shaft member 62 is provided so as to project to the front side from the base 12*a*, and it is inserted inside the movable body 13 from the rear side of the movable body, slidably in the longitudinal direction and in a non-rotatable fashion.

Figure 5:
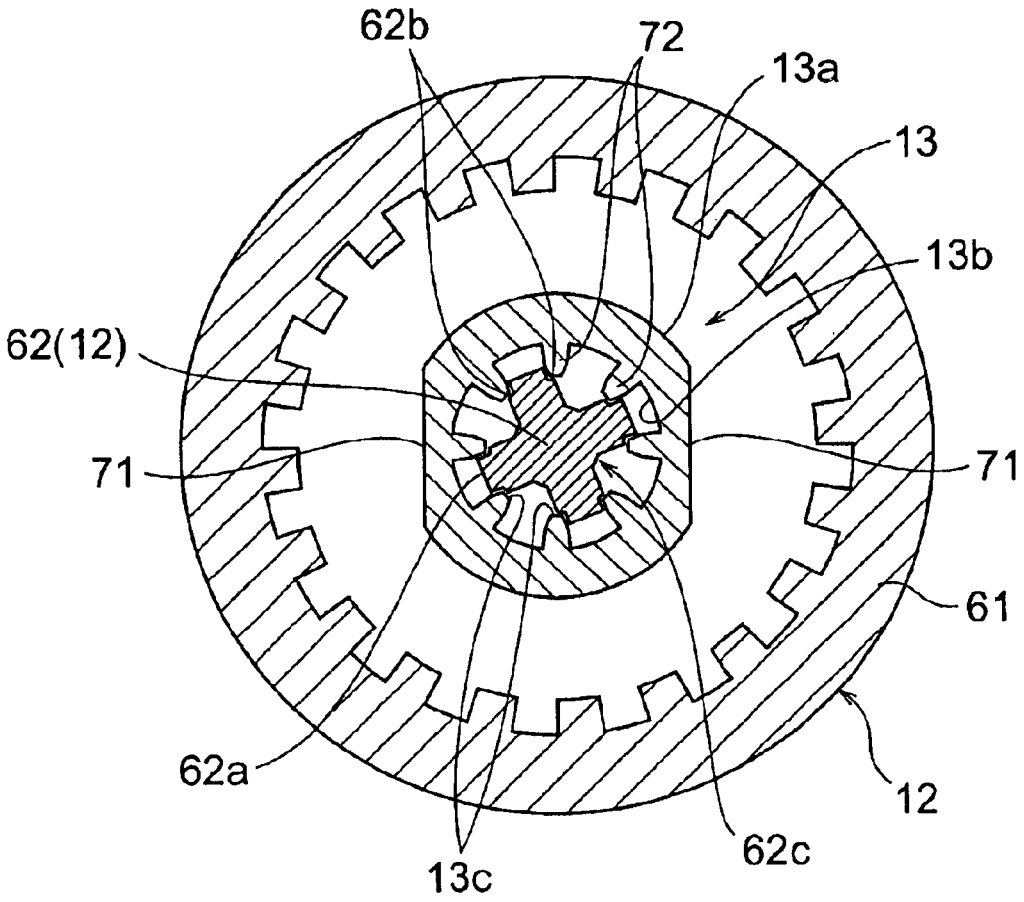
FIG. 5 is a sectional view along V—V in FIG. 1.

As shown in FIG. 4 and FIG. 5, the shaft member 62 is installed in a standing position in such a manner that it faces towards the front end side from the middle of the base 12*a*, and it has an approximately cross-shaped form. The shaft member 62 is formed integrally with the operating tube 61, from the viewpoint of reducing the number of components and facilitating the assembly process, but it may also be formed as a separate member which is coupled by insertion fitting, screw fitting, or the like.

In other words, by means of a shaft member 62 of this kind, it is possible to transmit the rotational force of the operating member 12 to the movable body 13 by means of a composition wherein it is inserted into the movable body 13 from the rear side of the movable body, and hence it is possible to maintain the same dispensing amount whilst shortening the overall length, compared to a conventional movable body dispensing device.

Here, as illustrated in FIG. 5, the shaft member 62 comprises a tube side rotation stopping (preventing) section on the outer circumference thereof. In other words, the shaft member 62 is formed with a plurality of depression sections (in the present embodiment, four depression sections) 62*c* having a recess shaped cross-section, by excavating respective positions at 90° intervals in the circumferential direction, in a recess shaped cross section, in addition to which, a plurality of projecting ribs (in the present embodiment, four projecting ribs) 62*a* respectively projecting towards the outer side and extending in the longitudinal direction are formed on either side of the depression sections 62*c* in the circumferential direction. Moreover, as FIG. 5 also shows, the movable body 13 is provided with a movable body rotation halting (preventing) section on the inner circumference thereof. In other words, a plurality of grooves 13*b* which fit together with the projecting ribs 62*a* are formed on the inner circumference of the movable body 13, and projecting ribs 72 are formed on either side of these grooves 13*b*. The front end edges of the projecting ribs 72 of the movable body 13 form supported edges 13*c*, constituting supported sections which are supported by the shaft member 62.

Moreover, as also shown in FIG. 5, the projecting ribs 62*a* of the shaft member 62 are constituted by projecting ribs which are slightly larger than the size of the grooves 13*b* of the movable body 13, in the region from the intermediate portion of the projecting ribs 62*a* until the base end side thereof, in such a manner that the projecting ribs 62*a* can be inserted inside the grooves 13*b* of the movable body 13, from the front end side until the intermediate portion of the projecting ribs 62*a*, whilst further insertion thereof beyond this is prevented and the movable body 13 and the shaft member 62 are maintained in a prescribed relative position in the radial direction (thereby preventing divergence between the central axles of same). Step sections in the intermediate portion of the projecting ribs 62*a* form supporting edges 62*b* which constitute supporting sections for supporting the supported edges 13*c* of the movable body 13. The composition for preventing further insertion of the projecting ribs 62*a* of the shaft member 62 inside the grooves 13*b* is not limited to the step-shaped step sections according to the present embodiment, it also being possible to adopt projecting ribs having oblique faces, or the like, or to adopt projecting ribs having a collar section, or the like, and in short, the intermediate regions of the projecting ribs 62*a* should be formed to a larger size than the front end sections thereof which are inserted inside the grooves 13*b*, and they should also be formed to a larger size than the grooves 13*b*.

Here, it is also possible to envisage a comparative composition wherein the shaft member is formed with a circular cross section, projecting ribs being provided at prescribed positions on the outer circumference of the circular, and slightly larger holes and grooves are formed on the movable body in a corresponding pattern to the shaft member provided with the projecting ribs, thereby maintaining the movable body and the shaft member in a prescribed relative position in the radial direction, but in the composition of this comparative example, there would be a large difference between the material thickness of the regions of the shaft member other than the projecting ribs (the shaft core portion) and the material thickness of the projecting ribs, and consequently, the surface of the moulded component is liable to have sink mark and in order to prevent such the sink mark, it is necessary to increase the moulding time, in addition to which, deformations, such as warping, bending, fracturing, or the like, become liable to occur due to the residual stress, in accordance with the non-uniform hardness caused by the non-uniform material thickness.

However, in the present embodiment, the composition of the projecting ribs 62*a* of the shaft member 62 formed by excavating same in a recess shaped cross section in a plurality of locations involves inserting the region from the front end to the intermediate portion thereof inside the grooves 13*b* of the movable body 13, the portion from the intermediate portion to the base end side being formed to a larger size than the intermediate portion inserted into the grooves 13*b*, but since the composition involves the formation of projecting ribs, the form of the shaft member 62 including the projecting ribs 62*a* can be approximated to a composition wherein projecting ribs extend radially from the central axis of the shaft, as in a cross-shaped cross-section, for example, in such a manner that the material thickness of the shaft member 62 can be homogenized throughout the whole shaft member 62, in comparison to the aforementioned comparative example.

(3) Movable Body 13

As shown in FIG. 5, the movable body 13 is formed in a cylindrical shape and a male screw thread 13*a* is formed on the external circumference thereof.

More specifically, as this diagram also shows, the movable body 13 comprises two planar face sections 71 formed at mutually opposing positions on the external circumference of a cylindrical member and extending along the full length thereof, and a male screw thread 13*a* formed extending in the axial direction on the curved surface except for the two planar face sections 71.

Furthermore, as shown in FIG. 5, the internal diameter of the rear end side of the movable body 13 is a reduced diameter and a plurality of projecting ribs 72 extending in the axial direction are formed approximately equidistantly in the circumferential direction on the inner circumference of this rear end of reduced diameter.

As shown in FIG. 1, the movable body 13 is engaged slidably in the axial direction and in a non-rotatable fashion, with respect to the shaft member 62, by means of the front end section of the male screw thread 13*a* screwing together with the female screw thread 11*a* on the inner circumference of the cylindrical member 52, whilst the projecting ribs 62*a* of the shaft member 62 forming a approximate cross shape are positioned between the projecting ribs 72, 72, and in this state, the rear end faces of the projecting ribs 72 are disposed in the vicinity of the base end section of the shaft member 62.

More specifically, as shown in the diagram, in this state, the shaft member 62 and the female screw thread 11*a* on the cylindrical member 52 and ratchet teeth 14*a*, 14*b* are disposed in mutually overlapping positions in the same plane orthogonal to the axial direction.

(4) Ratchet 14

Figure 6:
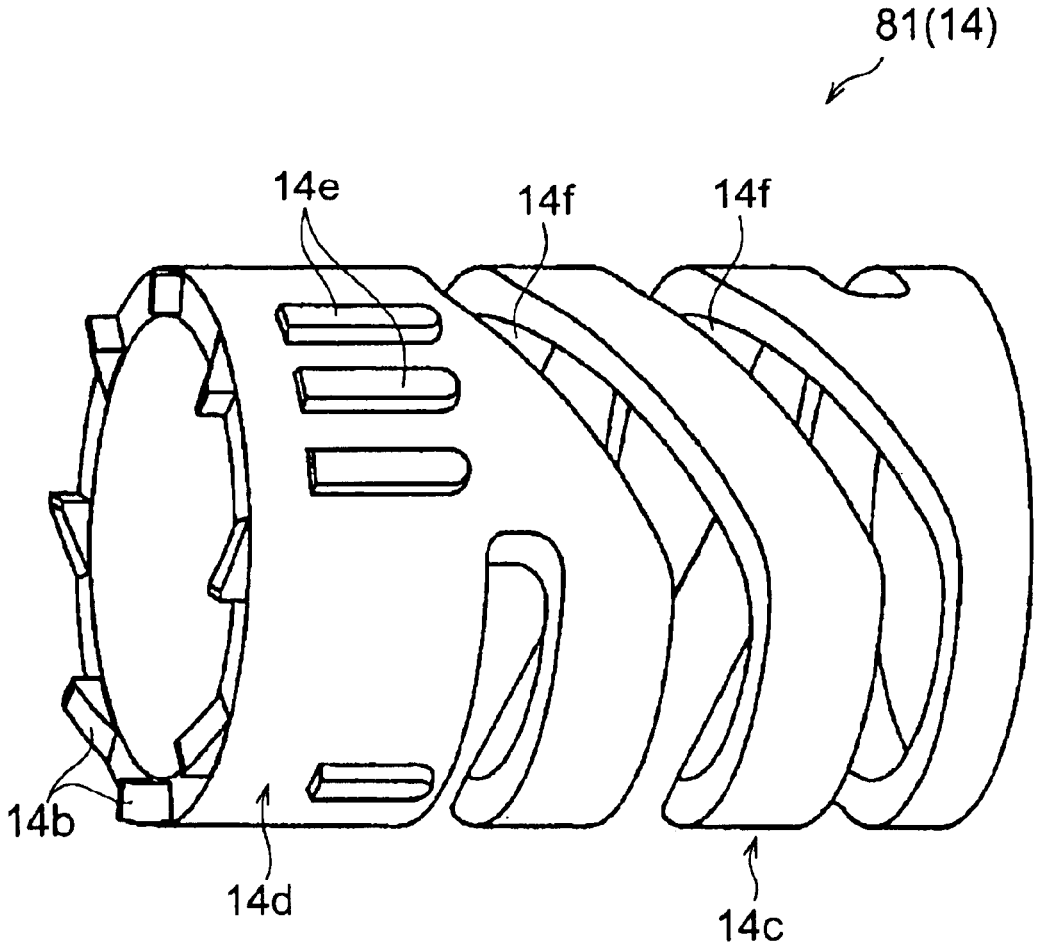
FIG. 6 is an oblique view showing a ratchet spring section (ratchet) in FIG. 1 and FIG. 2.

As illustrated in FIG. 3 and FIG. 6, the ratchet 14 comprises a set of ratchet teeth, in other words, the ratchet teeth 14*a* on the cylindrical member 52, and ratchet teeth 14*b* and ratchet spring 14*c* on the ratchet spring section 81, described hereinafter, and it is used in order to restrict the movement of the movable body 13 in the forward direction or rearward direction.

More specifically, as these diagrams illustrate, the ratchet 14 comprises a cylindrical ratchet spring section 81 in which either one of the sets of ratchet teeth 14*a*, 14*b*, and the ratchet spring 14*c* are formed in an integral fashion. As shown in FIG. 1 and FIG. 2, the ratchet spring section 81 is sandwiched between the collar section 11*b* of the cylindrical member 52 forming a step section and the spring pressers 12*b* of the operating tube 61 forming a projecting section, in such a manner that the shaft member 62 is able to penetrate through the inner side of the ratchet spring section 81 and thereby pass inside the movable body 13.

In other words, according to the ratchet spring section 81 of this kind, it is possible for the shaft member 62 to penetrate through the inner side thereof and thereby pass inside the movable body 13, and hence it is possible to maintain the same dispensing amount whilst shortening the overall length, in comparison with a conventional movable body dispensing device.

Of course, the ratchet spring section 81 is not limited to this and it is also possible for it to be provided sandwiched between the collar section 11*b* of the cylindrical member 52 forming the step section and the inner portion of the operating member 12, in such a manner that the shaft member 62 is able to penetrate through the inner side thereof and thereby pass inside the movable body 13. In other words, it is also possible to use a ratchet spring section 81 which is sandwiched, for example, between the collar section 11*b* of the cylindrical member 52 and the base 12*a* of the operating member 12, or the like.

More specifically, the ratchet spring section 81 is formed from synthetic resin, as illustrated in FIG. 7, and comprises a circular tube section 14*d* formed in a circular tube shape, and a ratchet spring 14*c* formed a circular tube shape provided consecutively to the rear end of the this circular tube section 14*d*.

As the diagram shows, the circular tube section 14*d* comprises a plurality of ratchet teeth 14*b*, provided at equidistant intervals in the circumferential direction on the front end face thereof, which project in an inclined fashion in such a manner that face towards to the front end side and mesh with the ratchet teeth 14*a*. Moreover, as shown in the diagram, a plurality of projecting ribs 14*e* extending for a prescribed length in the axial direction are formed on the outer circumference of the circular tube section 14*d* at equidistant intervals in the circumferential direction. Furthermore, as shown in this diagram, the ratchet spring 14*c* comprises a slit 14*f* cut out in a spiral fashion on the outer circumference thereof, in such a manner that the ratchet spring 14*c* can be extended or compressed by means of this slit 14*f*, thereby generating a force of impulsion.

As shown in FIG. 1, this ratchet spring section 81 is coupled in a non-rotatable manner to the operating tube 61, by means of the ratchet spring 14*c* being compressed between the collar section 11*b* of the cylindrical member 52 and the spring pressers 12*b* of the operating tube 61 and generating a force of impulsion in the longitudinal direction, the ratchet teeth 14*a*, 14*b* meshing together (the ratchet teeth 14*a*, 14*a* being positioned mutually between ratchet teeth 14*b*, 14*b*), and furthermore, the front end edge section of the collar section 11*b* of the cylindrical member 52 abutting the step section 51*d* of the rear end tube section 51*b*, in which state, the respective projecting ribs 14*e* of the circular tube section 14*d* are positioned between the respective projecting ribs 61*c*, 61*c* of the operating tube 61.

As described above, in the movable body dispensing device 1 of this kind, it is possible to transmit the rotational force generated by the operating member 12, to the movable body 13, by means of a shaft member 62 inserted slidably in the longitudinal direction in a non-rotatable manner inside the cylindrical shaped movable body 13, and moreover, the shaft member 62 penetrates the inside of the ratchet spring section 81 to enable the movable body 13 to pass through. Further, the shaft member 62 penetrates through the female screw thread 11*a* of the main body 11 which screws together with the male screw thread 13*a* of the movable body 13.

Consequently, according to the movable body dispensing device 1 of this kind, the shaft member 62 forming the tube side rotation preventing section and the female screw thread 11*a* of the main body 11 forming the tube side screw thread section overlap mutually in the same plane orthogonal to the axial direction, and furthermore, the shaft member 62 and the ratchet teeth 14*a*, 14*b* overlap mutually in the same plane orthogonal to the axial direction, thereby making it possible to shorten the overall length compared to the prior art, whilst maintaining the same dispensing amount, and hence allowing satisfactory downsizing of the eventual product.

Moreover, according to the movable body dispensing device 1, since the shaft member 62, the female screw thread 11*a* and the ratchet teeth 14*a*, 14*b* overlap mutually in the same plane orthogonal to the axial direction, further downsizing can be achieved.

Furthermore, according to the movable body dispensing device 1, since the intermediate portions of the projecting ribs 62*a* (the region from the intermediate portion to the base end in the present embodiment) are constituted by projecting ribs which are larger than the size of the grooves 13*b*, in such a manner that the region of the projecting ribs 62*a* from the front end side to the intermediate portion thereof can be introduced inside the grooves 13*b* of the movable body 13, and further insertion beyond this is prevented, the movable body 13 and the shaft member 62 being maintained in prescribed relative positions in the radial direction, then the projecting ribs does not need to be made longer than necessary, thereby making it possible to avoid unnecessary forming processes.

In addition, in a movable body dispensing device 1 of this kind, since the aforementioned projecting ribs 62*a* of the shaft member 62 are formed by excavating a plurality of locations in a recess shaped cross section, it is possible to approximate the shape of the shaft member 62 including the projecting ribs 62*a* to a composition wherein the projecting ribs extend radially from the central axis of the shaft, thereby making it possible to homogenize the material thickness throughout the whole shaft member 62.

As a result, the sink mark of the surface of the moulded components can be prevented, without lengthening the moulding time, and furthermore, an even hardness is achieved and hence deformations, such as warping, bending, fracturing, or the like, are not liable to occur.

In this way, according to the movable body dispensing device relating to the present invention, it is possible to shorten the overall length of the device in comparison to the prior art, whilst maintaining the same dispensing amount, thereby making it possible to compactify manufactured products satisfactorily.

What is claimed is:

1. A movable body dispensing device comprising: a cylindrical movable body having a male screw thread formed on the external circumference thereof; a cylindrical main body having a female screw thread which screws together with the male screw thread of said movable body, formed on the intermediate portion of the internal circumference thereof; a cylindrical operating member coupled rotatably to the rear end section of said main body, comprising a shaft member provided so as to project towards the front side from a base provided at the rear end thereof, said shaft member being fittable slidably in the longitudinal direction, in a non-rotatable fashion, into said movable body engaged with said female screw thread; and a ratchet comprising a set of ratchet teeth and a ratchet spring, for restricting the movement of said movable body in the forward direction or rearward direction; said movable body being progressively dispensed by causing relative rotation of said main body and said operating member;

wherein a step section is formed on the inner part of said cylindrical main body between the internal circumference of said intermediate portion and the internal circumference of the region apart from said intermediate portion;

said ratchet comprises a cylindrical ratchet spring section whereon at least one of said set of ratchet teeth and said ratchet spring are formed integrally; and said ratchet spring section is sandwiched between the step section of said main body and the inner side of said operating member, in such a manner that said shaft member penetrates through the inner side of said ratchet spring section and thereby enables said movable body to pass through the same.

2. A movable body dispensing device comprising: a cylindrical movable body having a male screw thread formed on the external circumference thereof; a cylindrical main body having a female screw thread which screws together with the male screw thread of said movable body, formed on the intermediate portion of the internal circumference thereof; and a cylindrical operating member coupled rotatably to the rear end section of said main body, comprising a shaft member provided so as to project towards the front side from a base provided at the rear end thereof, said shaft member being fittable slidably in the longitudinal direction, in a non-rotatable fashion, into said movable body engaged with said female screw thread; said movable body being progressively dispensed by causing relative rotation of said main body and said operating member;

wherein a plurality of projecting ribs respectively projecting to the outer side and extending in the longitudinal direction are formed in the circumferential direction on the external circumference of said shaft member;

a plurality of grooves which fit mutually with the projecting ribs of said shaft member are formed on the internal circumference of said movable body; and said projecting ribs of said shaft member are constituted by projecting ribs wherein the intermediate portion thereof is larger than the size of said grooves, in such a manner that the region thereof from the front end side to said intermediate portion thereof can be inserted inside the grooves of said movable body, further insertion beyond this being prevented and said movable body and said shaft member being maintained in prescribed relative positions in the radial direction.

3. The movable body dispensing device according to claim 2, wherein the projecting ribs of said shaft member are formed on either side of depressions having a hollow cross section, by excavating a plurality of locations so as to form a hollow cross section.

4. A movable body dispensing device comprising: a main body tube; an operating tube provided on the rear end section of said main body tube and capable of relative rotation with respect to said main body tube; a movable body comprising a rotation preventing section and a screw thread section, inserted inside said main body tube and said operating tube; a tube side rotation preventing section for engaging in a non-rotatable fashion with the rotation preventing section of said movable body and guiding said movable body slidably in the axial direction; a tube side screw thread section for engaging with the screw thread section of said movable body; and ratchets provided respectively on the main body tube and the operating tube, for mutually meshing and permitting rotation in one direction in synchronism with said relative rotation; said movable body being dispensed progressively towards the front end of said main body tube by means of the engagement of said screw thread sections, the screwing together of said rotation preventing sections, and the meshing of said ratchets;

wherein said movable body is formed in a cylindrical shape, and provided with the screw thread section of said movable body on either one of the inner circumference or external circumference thereof, and with the rotation preventing section of said movable body on the other of said inner circumference or external circumference; and said tube side rotation preventing section, said tube side screw thread section and said ratchets are arranged in an overlapping fashion in the same plane orthogonal to the axial direction.

5. The movable body dispensing device according to claim 4, comprising:

a shaft member installed on the base section of the operating tube so as to protrude in the axial direction; and a cylindrical member having a cylindrical shape and being installed so as to surround the front end side of said shaft member, whilst also being coupled in a non-rotatable fashion to said main body tube;

wherein said movable body is inserted in between said shaft member and said cylindrical member, the rotation preventing section of the movable body being provided on the internal circumference of said movable body, and the screw thread section of the movable body being provided on the external circumference of said movable body;

said tube side rotation preventing section is provided on the external circumference of said shaft member and engages with the rotation preventing section of the movable body formed on the internal circumference of said movable body;

said tube side screw thread section is provided on the internal circumference of said cylindrical member and screws together with the screw thread section of the movable body on the external circumference of said movable body; and said ratchets are arranged in such a manner that they surround said cylindrical member.

6. The movable body dispensing device according to claim 4, comprising:

a shaft member installed on the base section of the operating tube in a protruding manner in the axial direction; and a cylindrical member having a cylindrical shape and being installed so as to surround the front end side of said shaft member, whilst also being coupled in a non-rotatable fashion to said main body tube;

wherein said movable body is inserted in between said shaft member and said cylindrical member, the rotation preventing section of the movable body being provided on the external circumference of said movable body, and the screw thread section of the movable body being provided on the internal circumference of said movable body;

said tube side rotation preventing section is provided on the internal circumference of said cylincrical member and engages with the rotation preventing section of the movable body formed on the external circumference of said movable body;

said tube side screw thread section is provided on the external circumference of said shaft member and screws together with the screw thread section of the movable body on the internal circumference of said movable body; and said ratchets are arranged in such a manner that they surround said cylindrical member.

* * * * *